US006598413B2

(12) United States Patent
Asahina et al.

(10) Patent No.: US 6,598,413 B2
(45) Date of Patent: Jul. 29, 2003

(54) CEILING EMBEDDED-TYPE AIR CONDITIONER

(75) Inventors: Manabu Asahina, Tokyo (JP); Hiroshi Nakashima, Tokyo (JP); Atsushi Edayoshi, Tokyo (JP); Kazunobu Sekiguchi, Tokyo (JP); Ryo Oya, Tokyo (JP); Tatsuo Sone, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/193,238

(22) Filed: Jul. 12, 2002

(65) Prior Publication Data

US 2002/0177400 A1 Nov. 28, 2002

Related U.S. Application Data

(62) Division of application No. 09/609,643, filed on Jul. 3, 2000, now Pat. No. 6,450,880.

(51) Int. Cl.[7] ..... F24F 1/00

(52) U.S. Cl. ..... 62/298; 62/259.1; 62/288; 62/290; 62/291

(58) Field of Search ..... 62/298, 259.1, 62/285, 288, 289, 290, 291

(56) References Cited

U.S. PATENT DOCUMENTS 3,766,750 A * 10/1973 Aoh et al. ..... 62/259.1
6,264,552 B1 7/2001 Oya et al.
6,393,856 B1 * 5/2002 Gunji et al. ..... 62/298

FOREIGN PATENT DOCUMENTS

| | | |
|---|---|---|
| JP | 62-108716 | 7/1987 |
| JP | 4-50319 | 4/1992 |
| JP | 4-57123 | 5/1992 |
| JP | 7-324769 | 12/1995 |
| JP | 7-332697 | 12/1995 |
| JP | 9-126538 | 5/1997 |

* cited by examiner

*Primary Examiner*—Harold Joyce
(74) *Attorney, Agent, or Firm*—Oblon, Spivak, McClelland, Maier & Neustadt, P.C.

(57) ABSTRACT

An object of this invention is to avoid squeaks caused. There is provided a ceiling embedded-type air conditioner in which a decorative panel (20) having an air suction port (21) and air blow-off ports (22) is detachably mounted onto the air conditioner main body (10), in which three sides of a pedestal portion made of sealing material (27) for sealing the outer circumference of the rectangular air blow-off port (22) are configured by reinforcing ribs (28*a*, 28*b*) obtained by integrally molding with the decorative panel, and only one side of the pedestal portion is configured by an air guide member (29) made of a foaming resin molded part.

6 Claims, 11 Drawing Sheets

CEILING EMBEDDED-TYPE AIR CONDITIONER

This application is a division of application Ser. No. 09/609,643, filed on Jul. 30, 2000 now U.S. Pat. No. 6,450,880.

BACKGROUND OF THE INVENTION

The present invention relates to a ceiling embedded-type air conditioner, and more particularly to a structure relating to a decorative panel to be detachably mounted to the air conditioner main body.

FIGS. 8 and 9 show a decorative panel portion of a conventional ceiling embedded-type air conditioner. In these figures, a reference numeral 100 denotes the main body (hereinafter, maybe referred to as air conditioner main body) of the ceiling embedded-type air conditioner, and 110, a decorative panel. The decorative panel 110 has a square air suction port 111 in the central portion, and rectangular air blow-off ports 112 in the outside of each side of the air suction port 111 respectively.

In the air suction port 111, there are disposed a suction grille 113 and an air filter element 114, and a vane 115 is pivotally mounted to the air blow-off port 112.

The air blow-off port 112 is demarcated substantially over the entire surface by a frame-shaped air guide member 116 made of a foaming resin molded part fitted in and mounted to the decorative panel 110. The air guide member 116 constitutes the entire contour of the air blow-off port 112 on the air conditioner main body connection side, and serves as a pedestal of sealing material 117 interposed between the air conditioner main body 100 and the air guide member 116. The decorative panel 110 is integrally formed with mounting piece portions 119, each of which has a screw-through hole 118, at four corners of the air suction port 111, and is fixed to the air conditioner main body 100 with mounting screws 120 passed through the screw-through holes 118.

As another conventional example of ceiling embedded-type air conditioner, there is one disclosed in Japanese Patent Laid-Open No. 7-324769. FIGS. 10 and 11 show a ceiling embedded-type air conditioner disclosed in the Japanese Patent Laid-Open No. 7-324769. In this respect, in FIGS. 10 and 11, the same or equivalent components as those shown in FIGS. 8 and 9 are represented by the same reference numerals as shown in FIGS. 8 and 9, and description thereof will be omitted.

In this ceiling embedded-type air conditioner, a triangular opening 121 each is formed at the four corners of the decorative panel 110 in such a manner as to be able to adjust the suspension height of the air conditioner main body 100 by means of the opening 121 while the decorative panel 110 is mounted to the air conditioner main body 100.

The opening 121 is configured so as to be covered with a decorative lid (corner panel) 122 to be detachably mounted to the decorative panel 110. This decorative lid 122 is mounted by catching a hook-shaped engaging piece 123 obtained by integrally molding with the decorative lid 122 on an engaging hole 124 engaged with the decorative panel 110 to cause a permanent magnet piece 125 mounted to the decorative lid 122 to be magnetically attracted to a metallic plate 126 mounted to the decorative panel 110.

In such a conventional ceiling embedded-type air conditioner as shown in FIGS. 8 and 9, a member forming the air course (air blow-off port 112) of the decorative panel is an air guide member 116 consisting of a plastic molded portion of the decorative panel 110 and an air guide member 116 made of a wide range of forming resin material. Therefore, a difference in coefficient of linear expansion of these dissimilar materials causes slippage between the plastic portion (decorative panel 110) and the foaming resin portion (air guide member 116), and squeaks are prone to occur.

Since a fixing portion between the decorative panel 110 and the air conditioner main body 100 is located within the air suction port 111, it is difficult to improve the durability due to crazing destruction on the mounting piece portion 119 particularly in a severe usage environment in which lamp black and the like are sucked in.

In the conventional ceiling embedded-type air conditioner, since the structure is arranged so that the vane, a motor for driving it and the like are mounted from the non-design surface side of the decorative panel, the decorative panel must be removed from the air conditioner main body each time during servicing such as replacement of those components, and is inferior in service workability.

During an emergency operation because of drainage pump trouble, a marketing hose is connected to a natural drainage port formed in the drainage pan of the air conditioner main body for cooling operation. Since, however, the position of the natural drainage port is located in the air suction port in the conventional ceiling embedded-type air conditioner, there is no alternative but to operate in a state in which the suction grille is opened during this emergency operation, and the operation is performed in a state in which indoor dust particles and the like are not removed by the filter element in the air suction port. Thus, trouble due to clogging in the heat exchanger of the air conditioner main body is prone to occur.

In the conventional ceiling embedded-type air conditioner, the decorative panel and the drainage pan must be removed from the air conditioner main body in order to sweep the suction port of the drainage pump and the drainage pan, and the air conditioner is inferior in sweeping workability.

In a ceiling embedded-type air conditioner disclosed in the Japanese Patent Laid-Open No. 7-324769, since the decorative lid is mounted by means of the claw engagement and a magnet, the mounting strength of the decorative lid is somewhat improved, and it becomes difficult to cause rattling vibration in the decorative lid. In order to obtain sufficient performance, the magnetic strength of the permanent magnet piece 125 must be made substantially great, or any large permanent magnet piece 125 must be used.

In the conventional ceiling embedded-type air conditioner, when the air conditioner main body is installed at an installation height higher than a recommended height or the ceiling material becomes deformed, a gap occurs between the ceiling material and any corner portion of the decorative panel, and this gap causes dewing on the design surface of the decorative panel because of a temperature difference between within the ceiling and indoors, and the air conditioner also looks worse.

SUMMARY OF THE INVENTION

The present invention has been achieved in order to solve the above described problems, and its object is to provide a ceiling embedded-type air conditioner without causing any squeaks, excellent in durability in installing the decorative panel and corner panels, in service workability in the vane and motor for driving the vane, and in workability in sweeping the suction port for the drainage pump and drainage pan, capable of performing an emergency operation without adversely affecting the air conditioner main body side, and eliminating any gaps between the ceiling material and any of corners of the decorative panel even if the ceiling material becomes deformed.

In order to achieve the above described object, there is, according to the present invention, provided a ceiling embedded-type air conditioner, in which a decorative panel having an air suction port and air blow-off ports is detachably mounted onto the air conditioner main body, in which three sides of a pedestal portion made of sealing material for sealing the outer circumference of a rectangular air blow-off port are configured by reinforcing ribs obtained by integrally molding with the decorative panel, and only one side of the pedestal portion is configured by an air guide member made of a foaming resin molded part.

A ceiling embedded-type air conditioner according to another aspect of the present invention has double-wall structure in which the reinforcing rib has an insulated space portion.

According to another aspect of the present invention, there is provided a ceiling embedded-type air conditioner in which a decorative panel having an air suction port and air blow-off ports is detachably mounted onto the air conditioner main body, in which the structure is arranged so that a vane bushing for pivotally supporting a vane which is provided at the air blow-off port in order to change the direction of a wind is mounted so as to be fitted in from the design surface side of the decorative panel, and that the vane and the motor for driving it are mounted from the design surface side of the decorative panel.

According to another aspect of the present invention, there is provided a ceiling embedded-type air conditioner in which a decorative panel having an air suction port and air blow-off ports is detachably mounted onto the air conditioner main body, in which an opening for a piping/wiring operation and a pedestal portion are formed in each of corner portions of the decorative panel, these portions are configured to be covered with a corner panel to be detachably mounted to the decorative panel, and a mounting portion between the decorative panel and the air conditioner main body is arranged on the pedestal portion.

According to another aspect of the present invention, there is provided a ceiling embedded-type air conditioner, in which on a corner portion to be covered with the corner panel, there is provided a screw-through hole for screwing the decorative panel to the ceiling material.

According to another aspect of the present invention, there is provided a ceiling embedded-type air conditioner in which a decorative panel having an air suction port and air blow-off ports is detachably mounted onto the air conditioner main body, in which an opening for a piping/wiring operation is formed in each of corner portions of the decorative panel, this portion is configured to be covered with a corner panel to be detachably mounted to the decorative panel, a suction grille for covering the air suction port is detachably mounted to the decorative panel, and the corner panel is fixed to the decorative panel in a mode in which an engaging piece, which is an integral part of the corner panel, engages with an engaging hole formed on the decorative panel, and an engaging claw, which is an integral part of the corner panel, is interposed between the suction grille and the decorative panel.

According to another aspect of the present invention, there is provided a ceiling embedded-type air conditioner in which a decorative panel having an air suction port and air blow-off ports is detachably mounted onto the air conditioner main body, in which an opening for a piping/wiring operation is formed in each of corner portions of the decorative panel, this portion is configured to be covered with a corner panel to be detachably mounted to the decorative panel, a natural drainage port to be formed in a drainage pan in the air conditioner main body is located at a position corresponding to each of corner portions of the decorative panel to be covered with the corner panels, and a hose-through hole is formed in the corner portion of the decorative panel to be covered with the corner panel, at a position which matches to the natural drainage port.

According to another aspect of the present invention, there is provided a ceiling embedded-type air conditioner, in which the drainage pan has a shelf portion one step higher than the bottom surface of the drainage pan, a natural drainage port is formed on the shelf portion, a sweeping hole is formed in the bottom surface of the drainage pan, and a sweep-working hole is formed in each of corner portions of the decorative panel to be covered with the corner panel, at a position which matches to the sweeping hole.

According to another aspect of the present invention, there is provided a ceiling embedded-type air conditioner, in which the sweep-working hole is provided right below the suction port of the drainage pump.

According to a ceiling embedded-type air conditioner of the present invention as understood from the foregoing description, three sides of the pedestal portion of sealing material for sealing the outer periphery of a rectangular air blow-off port are configured by reinforcing ribs obtained by integrally molding with the decorative panel, only one side of the pedestal portion is configured by an air guide member made of a foaming resin molded part. Therefore, the usage of dissimilar material (foaming resin material) can be reduced, there can be obtained such structure that it is difficult for squeaks caused by a difference in coefficient of linear expansion between plastic and foaming resin to be generated, and no squeaks are generated.

According to a ceiling embedded-type air conditioner of another aspect of the present invention, since the reinforcing rib has double-wall structure having an insulated space portion, a heat insulation effect can be obtained, and the power consumption can be reduced.

According to a ceiling embedded-type air conditioner of another aspect of the present invention, since the vane and a motor for driving it can be mounted from the design surface side of the decorative panel, only faulty components can be serviced without removing the decorative panel during servicing, and the workability and serviceability on mounting the vane and the motor for driving it can be enhanced.

According to a ceiling embedded-type air conditioner of another aspect of the present invention, since a portion for mounting the decorative panel to the air conditioner main body is arranged in the pedestal portion to be covered with the corner panel, this mounting portion is not exposed to convection of indoor air containing lamp black and air within the ceiling, but the mounting durability of the decorative panel is improved, and moreover the appearance is not deteriorated because the mounting portion is covered with the corner panel.

According to a ceiling embedded-type air conditioner of another aspect of the present invention, since the corner portion of the decorative panel can be screwed to the ceiling material by passing the set-screws through the screw-through holes in the corner portion to be covered with the corner panel, any gap between the ceiling material and the corner portion of the decorative panel can be eliminated, and dewing on the decorative panel on the design surface side is not caused. Moreover, since the screwed portion is covered with the corner panel, the appearance is not deteriorated.

According to a ceiling embedded-type air conditioner of another aspect of the present invention, the engaging piece, which is an integral part of the corner panel, engages with the engaging hole formed in the decorative panel, and the corner panel is fixed to the decorative panel in a mode in which the engaging claw, which is an integral part of the corner panel, is interposed between the suction grille and the decorative panel, and therefore, the corner panel does not come off the decorative panel unless the suction grille is disengaged, is excellent in mounting reliability, and the corner panel does not rattle either.

According to a ceiling embedded-type air conditioner of another aspect of the present invention, the natural drainage port formed in the drainage pan in the air conditioner main body is located at a position corresponding to the corner portion of the decorative panel to be covered with the corner panel, and a hose-through hose is formed in the corner portion of the decorative panel to be covered with the corner panel at a position matching to the natural drainage port. Therefore, an emergency operation when the drainage pump is out of order can be performed in a state in which the suction grille is closed, and the emergency operation can be performed without adversely affecting the air conditioner main body.

According to a ceiling embedded-type air conditioner of another aspect of the present invention, in a portion of the drainage pan, there is formed a natural drainage port on a shelf portion which is one step higher than the bottom surface of the drainage pan, a sweeping hole is formed in the bottom surface of the drainage pan, and a sweep-working hole is formed in the corner portion of the decorative panel to be covered with the corner panel at a position for matching to the sweeping hole. Therefore, the drainage pan can be swept without removing the decorative panel and the drainage pan.

According to a ceiling embedded-type air conditioner of another aspect of the present invention, since the sweep-working hole is provided at a position right below the suction port in the drainage pump, the drainage pump suction port can be swept without removing the decorative panel and the drainage pan.

BEST MODE FOR CARRYING OUT THE INVENTION

Figure 1:
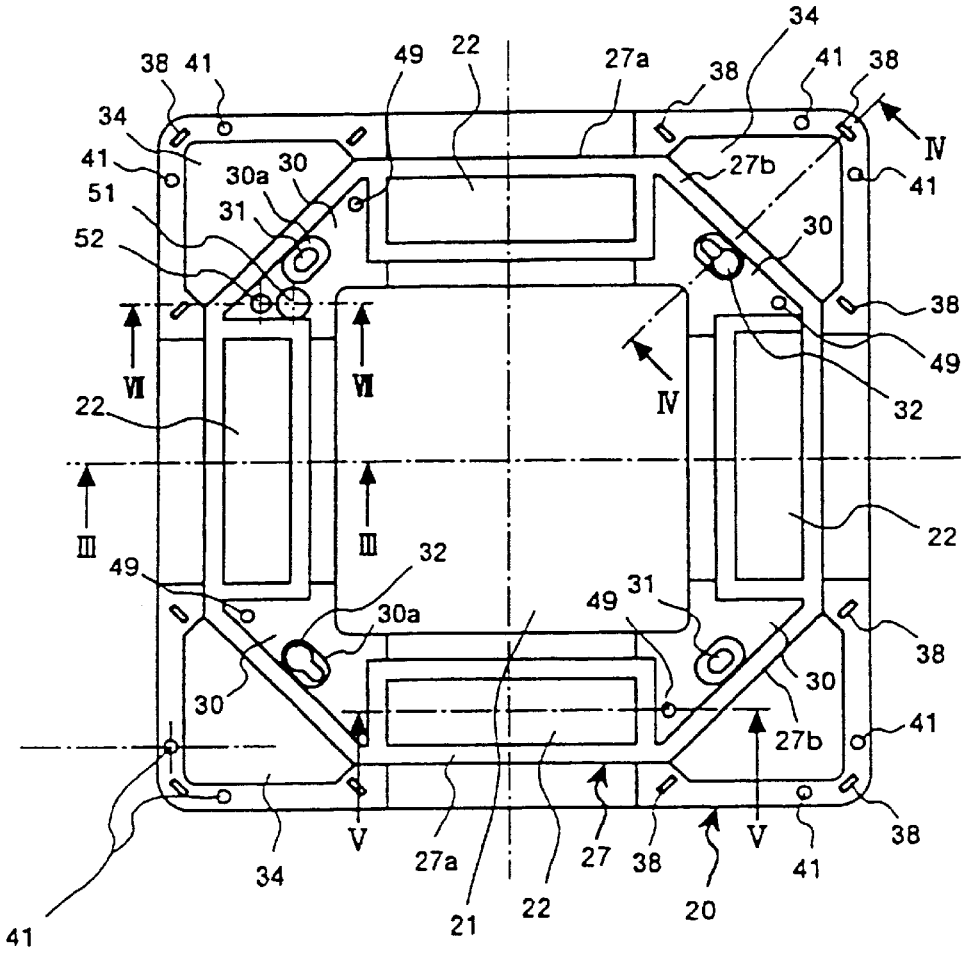
FIG. 1 is a plan view showing an embodiment of ceiling embedded-type air conditioner according to the present invention, as viewed from the non-design surface side of the decorative panel.

Hereinafter, with reference to the accompanying drawings, a detailed description will be made of embodiments of a ceiling embedded-type air conditioner according to the present invention.

FIGS. 1 to 7 show an embodiment of a ceiling embedded-type air conditioner according to the present invention. In these figures, a reference numeral 10 denotes the main body (air conditioner main body) of a ceiling embedded-type air conditioner to be fixed and arranged in the interior of the ceiling; 20, a substantially square decorative panel arranged at the front of the air conditioner main body 10 to cover an opening 91 of a ceiling panel 90; and 60, corner panels detachably mounted to four corners of the decorative panel 20 respectively.

The air conditioner main body 10 has an air suction passage portion 11 in the central portion, and an air blow-off passage portion 12 in the outside of the air suction passage portion 11 respectively, and there is arranged a heat exchanger 13 for heat-exchanging indoor suction air between the air suction passage portion 11 and the air blow-off passage portion 12. The decorative panel 20 is entirely configured by a molded part made of plastic material, has a square air suction port 21, which communicates with the air blow-off passage portion 12, in the central portion, and has a rectangular air blow-off port 22, which communicates with the air blow-off passage portion 12, in the outside of each side of the air suction port 21.

Figure 3:
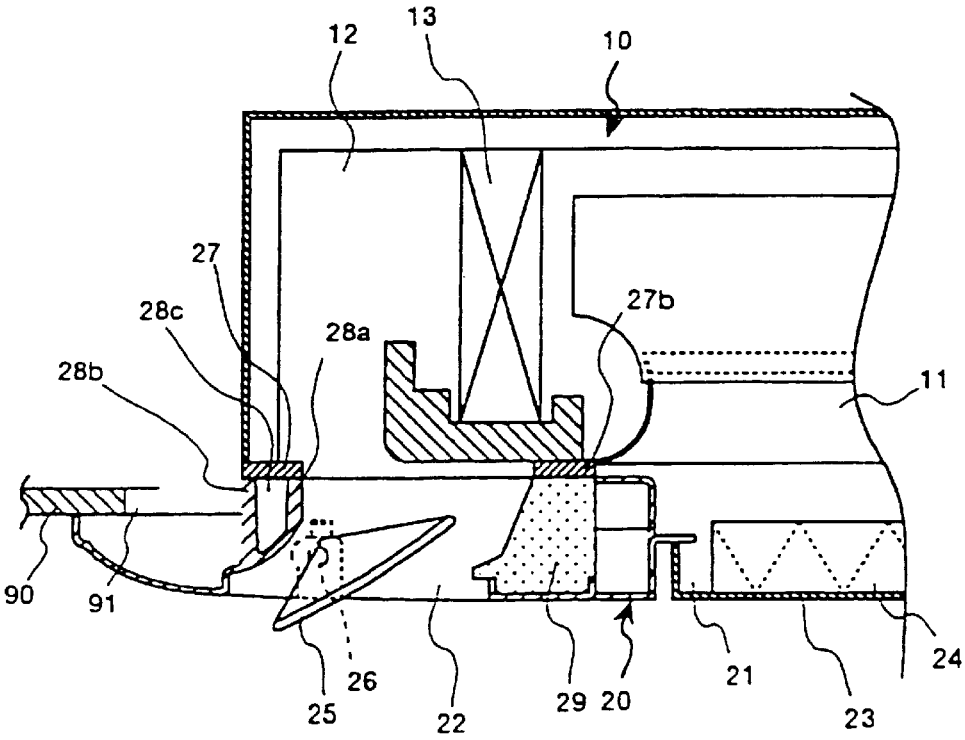
FIG. 3 is a sectional view taken on line III—III of FIG. 1.

In the air suction port 21, there are arranged a suction grille 23 and an air filter element 24, and in the air blow-off port 22, a vane 25 for changing the direction of a wind is pivotally mounted around an axis 26 as shown in FIG. 3. On the mounting surface of the decorative panel 20 to the air conditioner main body 10, there is provided sealing material 27 for separating the suction side from the blow-off side, in other words, for sealing the outer circumference of the air blow-off port 22.

The decorative panel 20 is, as a pedestal for the sealing material 27 as shown in FIG. 3, configured so that the outside of the air blow-off port 22 is configured by an inside reinforcing rib **28*a* and an outside reinforcing rib 28*b*, there is integrally molded a reinforcing rib of double-wall structure having an insulated space portion 28*c* between the inside reinforcing rib 28*a* and the outside reinforcing rib 28*b* is integrally molded, only the inside of the air blow-off port 22 is, from a molding viewpoint, configured by an air guide member 29 made of a foaming resin molded part, and those are bonded with the sealing material 27** in such a manner as to constitute a sealed pedestal surface which is flush with one another.

In this respect, sealed pedestal surfaces at both side ends of the air blow-off port 22 are also provided with reinforcing ribs obtained by integrally molding with the decorative panel 20. This means that three sides of the pedestal portion of the sealing material 27 are configured by reinforcing ribs obtained by integrally molding with the decorative panel 20. With this structure, the sealing material 27 is arranged so as to surround the air blow-off port 22 along the contour of the air blow-off port 22 to reliably separate the suction side from the blow-off side hermetically.

Such structure as described above enables usage of dissimilar members such as foaming resin to be reduced, makes it difficult to generate squeaks caused by a difference in coefficient of linear expansion between plastic material and foaming resin material which constitute the decorative panel 20, and provides a heat insulation effect because of the presence of an insulated space portion 28*c* in the reinforcing rib portion of the decorative panel 20.

Figure 4:
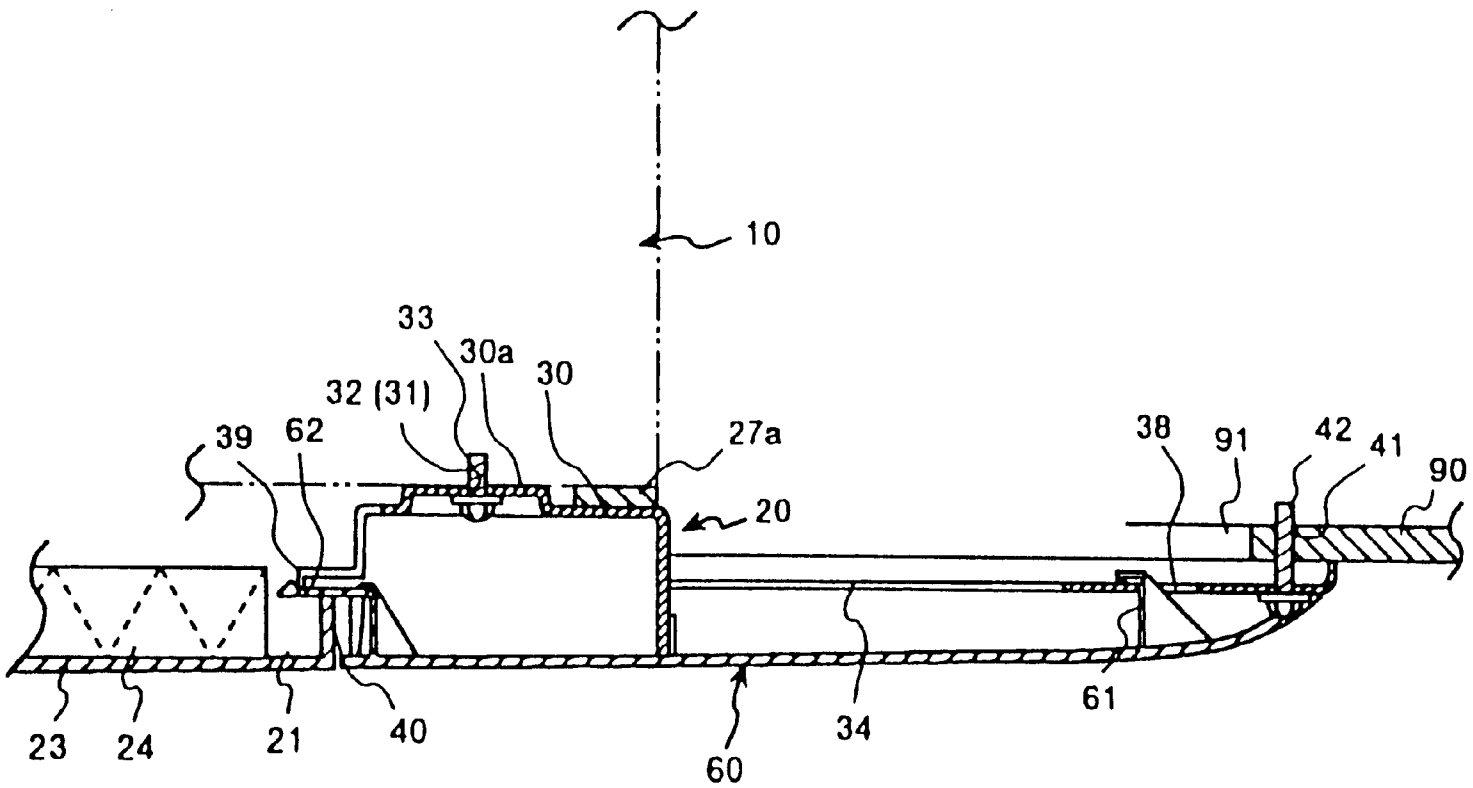
FIG. 4 is a sectional view taken on line IV—IV of FIG. 1.

In four corners of the decorative panel 20, a convexly-shaped pedestal portion 30 is integrally molded on the non-design surface side (air conditioner main body 10 side) as shown in FIGS. 1 and 4. The pedestal portion 30 is between the air blow-off ports 22 which are adjacent to each other, extends between the air blow-off ports 22 adjacent to the sealed pedestal surface consisting of an inside reinforcing rib 28*a*, an outside reinforcing rib 28*b* and the like which are flush therewith, and to this portion, a bridge portion 27*b* of the sealing material 27 is bonded. Thus, the sealing material 27 has monolithic structure in which four rectangular frame portions 27*a*, each of which matches to the contour of each air blow-off port 22, are connected together through bridge portions 27*b*.

The pedestal portion 30 is formed with a mounting foot 30*a*, which is formed with slot-shaped or keyhole-shaped screw-through holes 31 and 32. The decorative panel 20 is detachably fixed to the front (ceiling exposure surface) of the air conditioner main body 10 through mounting screws 33 which are caused to pass through these screw-through holes 31 and 32.

Since the mounting foot 30*a* is arranged in space isolated from the air suction port 21 for indoor air and air within the ceiling, the decorative panel 20 is fixed through the mounting screws 33 with high durability without making any immediate contact with indoor and within-ceiling convective air, and moreover, this mounted portion is covered with a corner panel 60 to be described later.

Figure 2:
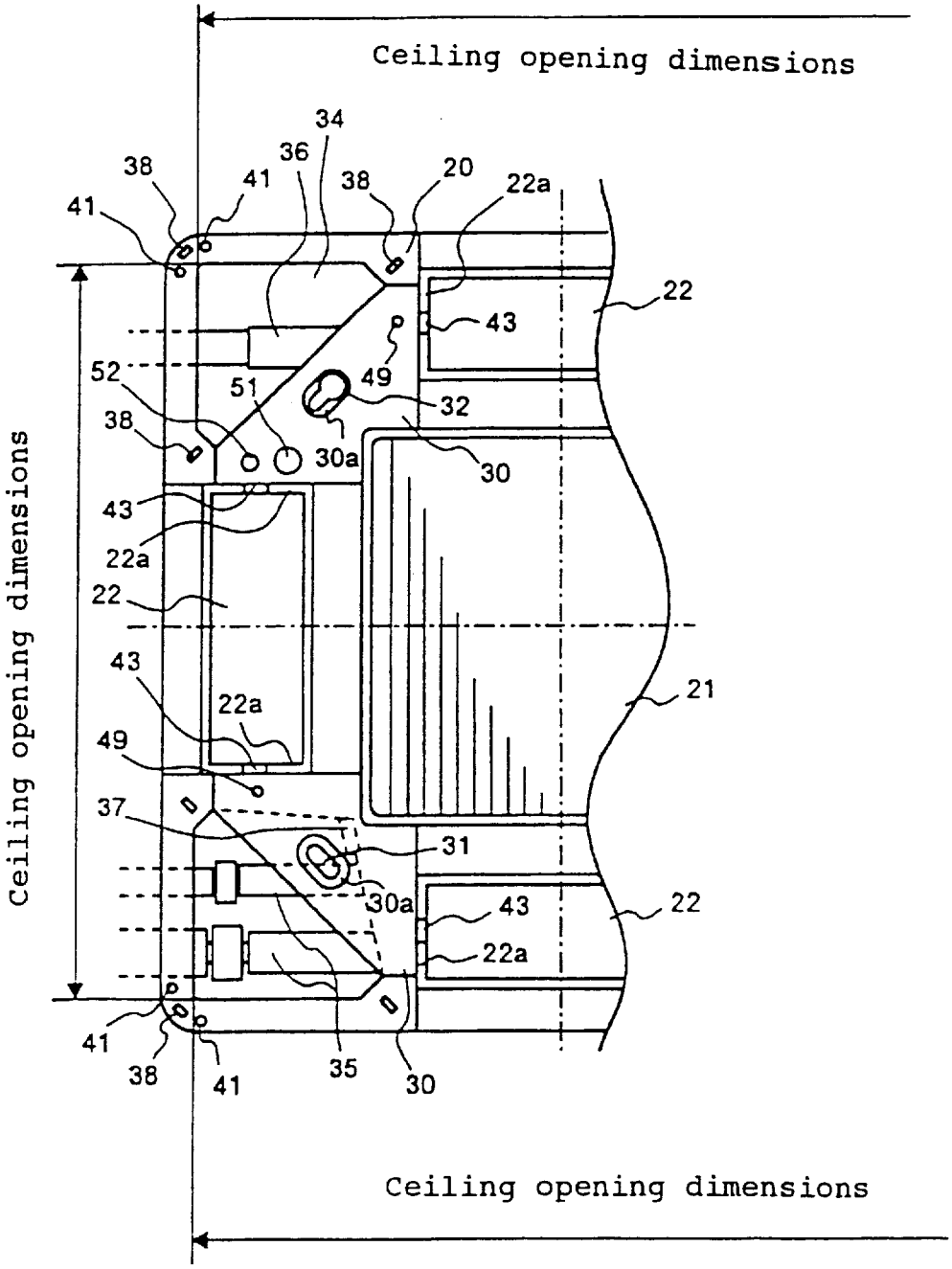
FIG. 2 is a partial plan view showing an embodiment of ceiling embedded-type air conditioner according to the present invention, as viewed from the design surface side of the decorative panel.

In each of the four corners (in the outside of the pedestal portion 30) of the decorative panel 20, a substantially triangular opening 34 is provided as shown in FIGS. 1, 2 and 4, and the structure is arranged so that the design surface side of the opening 34 and the pedestal portion 30 is covered with a corner panel 60 to be detachably mounted to the decorative panel 20.

Generally, ceiling opening dimensions are set larger than the air conditioner main body 10 so as to allow a piping and wiring operation to be performed after the installation of the air conditioner main body 10, and to such dimensions that the ceiling opening 91 is not exposed on the indoor side because the decorative panel 20 is mounted after the completion of the field works. Each of the openings 34 provided in the four corners of the decorative panel 20 has the same dimensions as the ceiling opening dimensions at maximum, and has an opening area required for a piping connecting operation for refrigerant piping 35 and drainage piping 36, and for a wiring operation for a field wiring intake 37 for the air conditioner main body 10, whereby the piping and wiring operations can be performed even after the decorative panel 20 is mounted, in other words, without removing it only by removing the corner panel 60.

Each of the corner panels 60 is structured by integrally molding hook-shaped engaging pieces 61 for engaging with engaging holes 38 provided at three places in each corner portion of the decorative panel 20 by sliding in the horizontal direction, and engaging claws 62 interposed between the rib 39 formed in the decorative panel 20 and the outer peripheral rib 40 of the suction grille 23.

The corner panel 60 is mounted by engaging each hook-shaped engaging piece 61 with engaging holes 38 in the decorative panel 20 by sliding it in the horizontal direction in a state, in which the suction grille 23 has been removed, to place it in a tacked state, and then by mounting the suction grille 23 onto the decorative panel 20 to thereby interpose the engaging claw 62 between the rib 39 and the outer peripheral rib 40.

This mounting construction causes the corner panel 60 not to come off the decorative panel 20 unless the suction grille 23 is disengaged, and causes the corner panel 60 not to rattle due to operating vibration of the air conditioner.

In each corner portion (edge portion in the outside of the opening 34) of the decorative panel 20, there are formed two screw-through holes 41, and a set-screw 42 is caused to pass through each of the screw-through holes 41. These set-screws 42 screw each corner portion of the decorative panel 20 at the ceiling panel 90. Thus, if the corner portions of the decorative panel 20 are not brought into tight contact with the ceiling panel 90, but there is a gap therebetween, it is possible to eliminate the gap by directly fixing the corner portions of the decorative panel 20 to the ceiling panel 90 with the set-screws 42. In this respect, the set-screws 42 are hidden by the corner panel 60, and cannot be seen from the design surface side. The appearance is not deteriorated.

Figure 5:
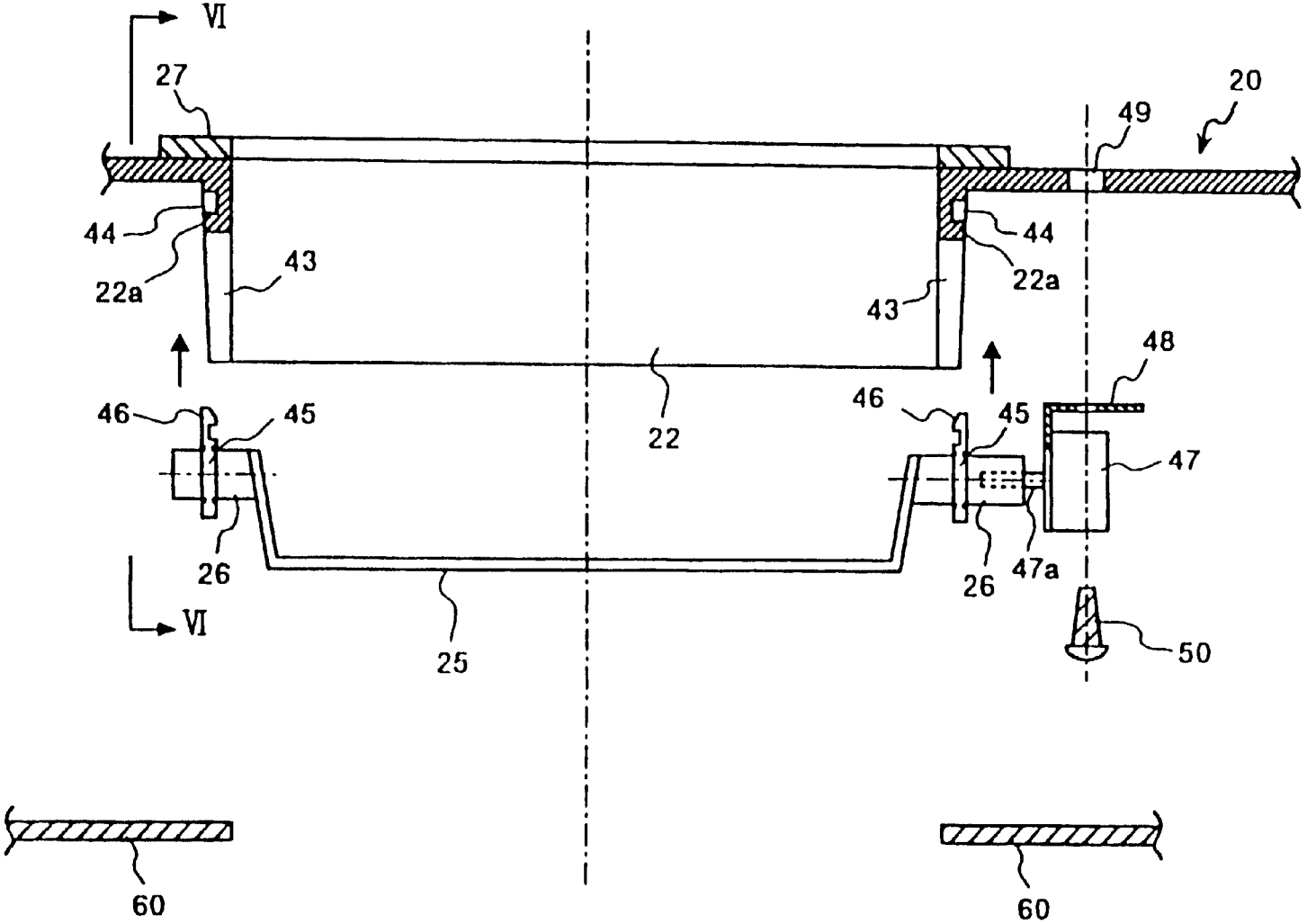
FIG. 5 is a sectional view taken on line V—V of FIG. 1.
Figure 6:
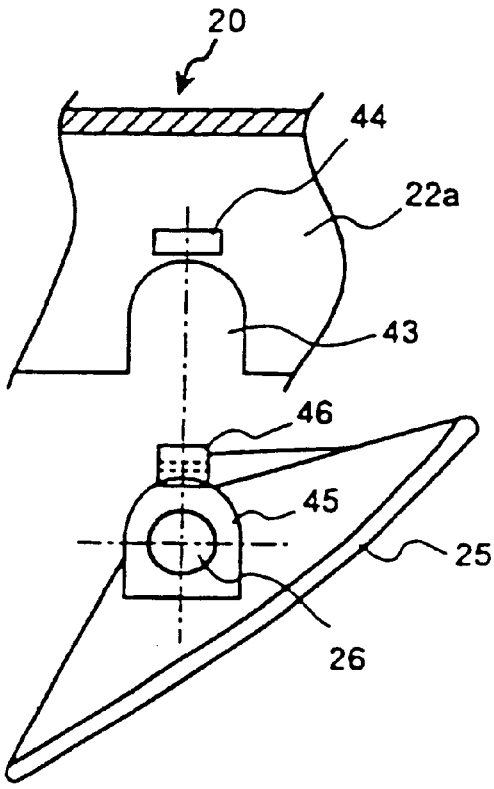
FIG. 6 is a sectional view taken on line VI—VI of FIG. 5.

On each of side wall portions 22*a*, for opposing to each other in each air blow-off port 22, there are formed a notched groove-shaped vane bushing engaging hole 43 opened on the design surface side and an engaging concave portion 44 as shown in FIGS. 5 and 6. With each of pivot 26 provided on both sides of the vane 25, a vane bushing 45 is engaged in a mode to allow the axis 26 to rotate, and the vane bushing 45 is fitted into a vane bushing engaging hole 43 in the decorative panel 20 together with the vane 25 from the design surface side, a check-shaped restraining claw 46 formed on the vane bushing 45 engages with an engaging concave portion 44, to thereby be fixed to the decorative panel 20 with a single motion.

One axis 26 of the vane 25 is drivingly coupled to an output shaft 47*a* of a vane driving motor 47. The vane driving motor 47 is located on the external side (design surface side of the pedestal portion 30 of the decorative panel 20) of the air blow-off port 22, mounted to a mounting sheet metal 48, and the mounting sheet metal 48 is fixed to the decorative panel 20 through a set-screw 50 to be screwed to a mounting hole 49 in the decorative panel 20.

In this way, the vane 25, the motor 47 for driving it, and the like can be mounted from the design surface side of the decorative panel 20, only faulty components can be serviced without removing the decorative panel 20 during servicing and the like, and the mountability and serviceability can be enhanced.

In this respect, the mounting portion and the like for the vane driving motor 47 are covered with the corner panel 60 for forming the design of the corner portion.

Figure 7:
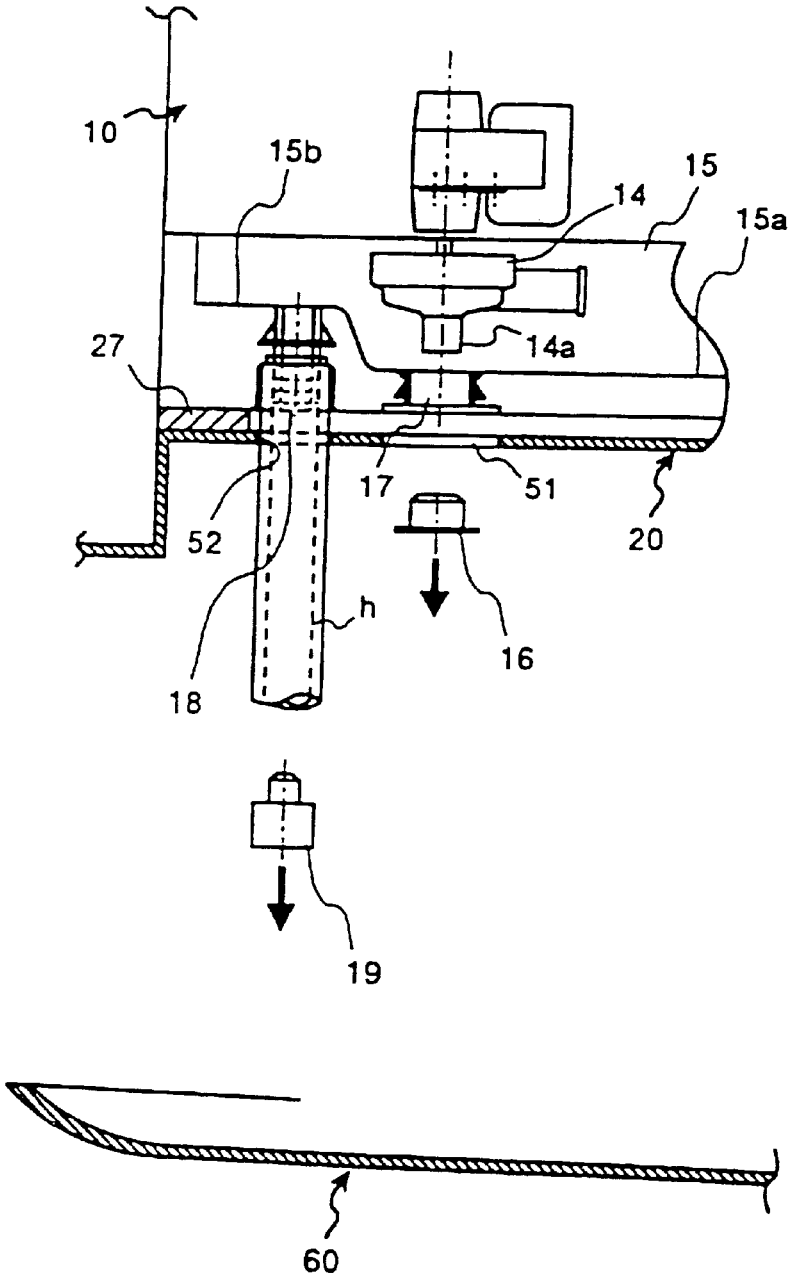
FIG. 7 is a sectional view taken on line VII—VII of FIG. 1.
Figure 8:
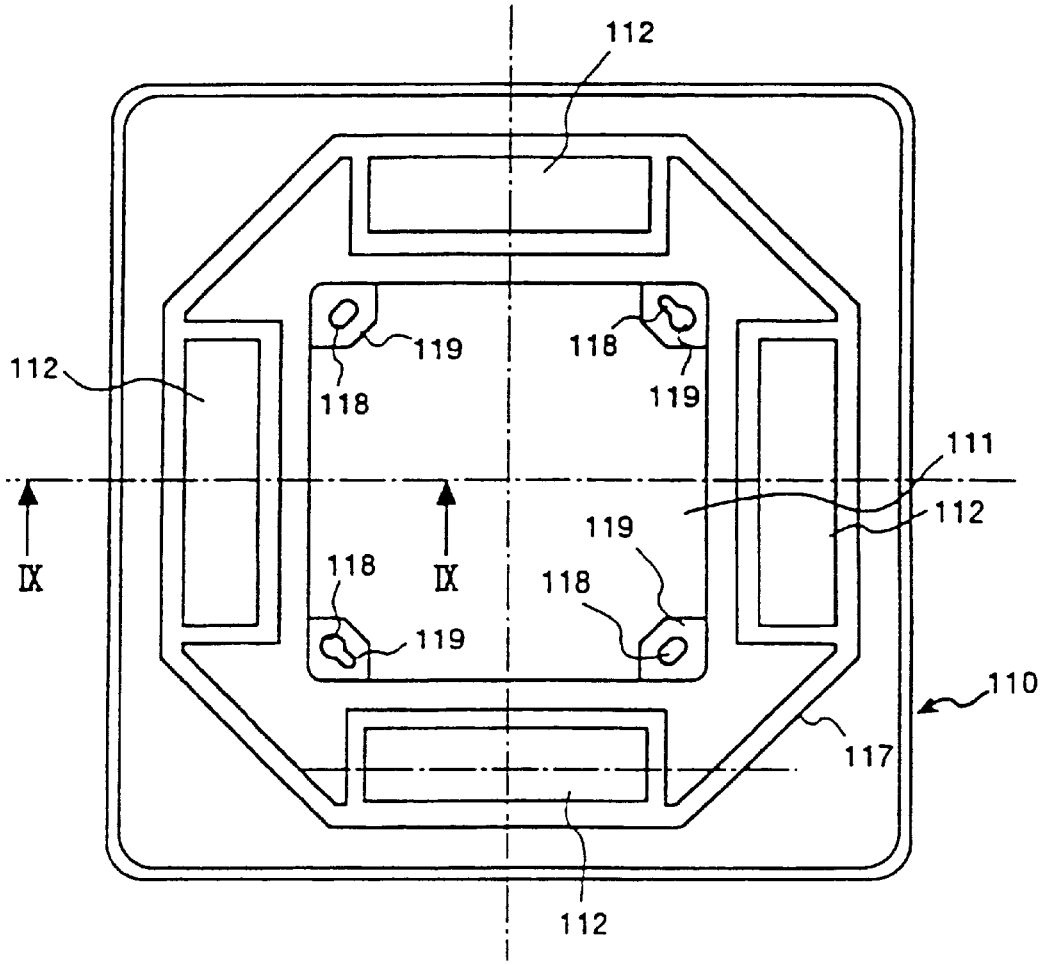
FIG. 8 PRIOR ART
FIG. 8 is a plan view showing a conventional ceiling embedded-type air conditioner, as viewed from the non-design surface side of the decorative panel.
Figure 9:
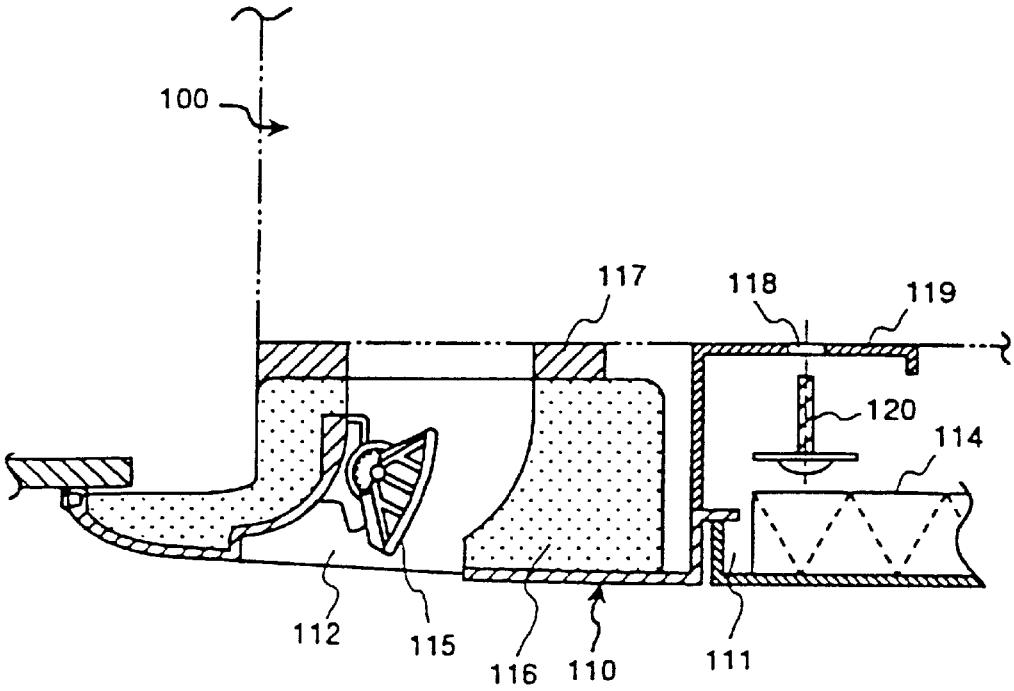
FIG. 9 PRIOR ART
FIG. 9 is a sectional view taken on line IX—IX of FIG. 8.
Figure 10:
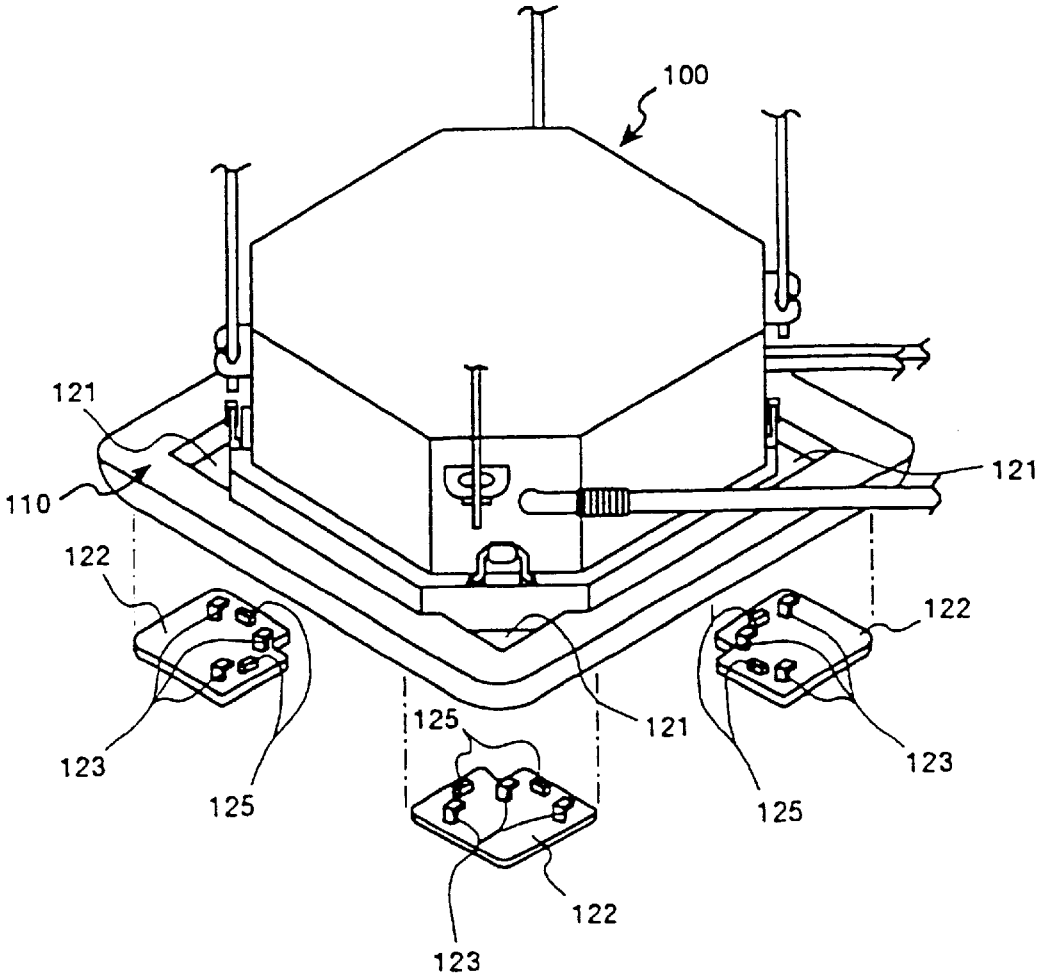
FIG. 10 PRIOR ART
FIG. 10 is a perspective view showing a conventional ceiling embedded-type air conditioner.
Figure 11:
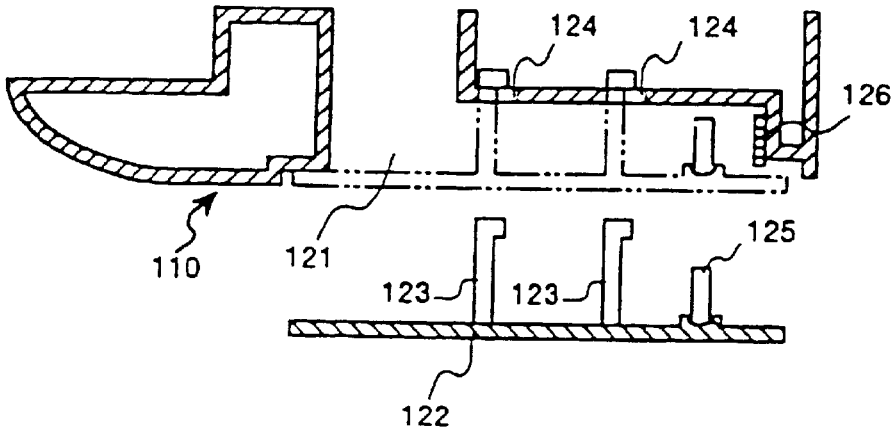
FIG. 11 PRIOR ART
FIG. 11 is a sectional view showing the mounting portion of the decorative lid in a conventional ceiling embedded-type air conditioner.

As shown in FIG. 7, the air conditioner main body 10 is mounted with a drainage pump 14 and a drainage pan 15, and the drainage pan 15 located right below a suction port 14*a* of the drainage pump 14 is formed with a sweeping hole 17 to be blocked up with a rubber stopper 16. The sweeping hole 17 is located at a position corresponding to the corner portion of the decorative panel 20 to be covered with the corner panel 60.

In a portion of the drainage pan 15, there is a shelf portion 15*b* which is one step higher than the bottom surface 15*a* of the drainage pan, and the shelf portion 15*b* is formed with a natural drainage port 18 for draining drainage water when the drainage pump 14 goes out of order. The natural drainage port 18 is usually blocked up with a rubber stopper 19, and is located at a position corresponding to the corner portion of the decorative panel 20 to be covered with the corner panel 60. The decorative panel 20 is formed with a sweep-working hole 51 and a hose-through hole 52 at respective positions matching to the sweeping hole 17 and the natural drainage port 18. The sweep-working hole 51 and the hose-through hole 52 are both in one corner portion of the decorative panel 20, and are covered with the corner panel 60.

In the case of naturally draining drainage water because of failure in the drainage pump 14, the corner panel 60 is removed, and the rubber stopper 19 is pulled out of the hole 52 in the decorative panel 20 to connect a marketing hose h to the natural drainage port 18. When it collects to some extent in the drainage pan 15 due to cooling operation, drainage water flows into the marketing hose h through the natural drainage port 18 to be naturally drained. In this way, an emergency operation at the time of failure in the drainage pump can be performed only by removing the corner panel 60 without removing the suction grille 23 and without adversely affecting the air conditioner main body 10 like dust sucking and the like.

In the case of sweeping the suction port 14*a* of the drainage pump 14 and the drainage pan 15, the rubber stopper 16 is pulled out of the hole 51 in the decorative panel 20 to sweep and remove any sludge-shaped dust and the like adhered to the suction port 14*a* in the drainage pump 14 and within the drainage pan 15 around it through the sweeping hole 17.

If sludge-shaped dust and the like are stacked and cannot be simply swept, liquid medicine is injected through the natural drainage port 18 in a state in which the rubber stopper 16 has been fitted in the sweeping hole 17. In this way, the medicine collects up to the height of the shelf portion 15*b* in the drainage pan 19, sludge-shaped dust and the like solidified are dissolved and fused, and thereafter, the rubber stopper 16 is removed from the drainage pan 15, and the dust and the like which have been dissolved and fused can be drained through the sweeping hole 17. In this way, the suction port 14*a* in the drainage pump 14 and the drainage pan 15 can be swept without removing the decorative panel 20 and the drainage pan 15 and the like.

What is claimed is:

1. A ceiling embedded-type air conditioner, in which a decorative panel having an air suction port and air blow-off ports is detachably mounted onto the air conditioner main body, characterized in that:

an opening for a piping/wiring operation and a pedestal portion are formed in each of corner portions of said decorative panel;

these portions are configured to be covered with a corner panel to be detachably mounted to said decorative panel; and a mounting portion between said decorative panel and said air conditioner main body are arranged on said pedestal portion.

2. The ceiling embedded-type air conditioner according to claim 1, characterized by further comprising, screw-through holes for screwing said decorative panel to the ceiling material in the corner portions to be covered with said corner panel.

3. A ceiling embedded-type air conditioner, in which a decorative panel having an air suction port and air blow-off ports is detachably mounted to the air conditioner main body, characterized in that:

an opening for a piping/wiring operation is formed in each of corner portions of said decorative panel;

this portion is configured to be covered with a corner panel to be detachably mounted to said decorative panel;

a suction grille for covering said air suction port is detachably mounted to said decorative panel; and said corner panel is fixed to said decorative panel in a mode in which an engaging piece being an integral part of said corner panel engages with an engaging hole formed in said decorative panel, and an engaging claw being an integral part of said corner panel is interposed between said suction grille and said decorative panel.

4. A ceiling embedded-type air conditioner, in which a decorative panel having an air suction port and air blow-off ports is detachably mounted to the air conditioner main body, characterized in that:

an opening for a piping/wiring operation is formed in each of corner portions of said decorative panel;

this portion is configured to be covered with a corner panel to be detachably mounted to said decorative panel;

a natural drainage port to be formed in a drainage in said air conditioner main body is located at a position corresponding to each of corner portions of said decorative panel to be covered with said corner panel; and a hose-through hole is formed in each of the corner portions of said decorative panel to be covered with said corner panel, at a position which matches to said natural drainage port.

5. The ceiling embedded-type air conditioner according to claim 4, characterized in that said drainage pan has a shelf portion one step higher than the bottom surface of said drainage pan;

said natural drainage port is formed in said shelf portion;

a sweeping hole is formed in the bottom surface of said drainage pan; and a sweep-working hole is formed in each of corner portions of said decorative panel to be covered with said corner panel, at a position which matches to said sweeping hole.

6. The ceiling embedded-type air conditioner according to claim 4, characterized in that said sweep-working hole is provided right below the suction port of said drainage pump.

* * * * *